US008261935B2

(12) United States Patent
Zeiler et al.

(10) Patent No.: US 8,261,935 B2
(45) Date of Patent: Sep. 11, 2012

(54) HINGED LID WITH RETAINING FEATURE

(75) Inventors: George Zeiler, Olathe, KS (US); Gregory L. Webb, Wilmington, OH (US)

(73) Assignee: Huhtamaki, Inc., De Soto, KS (US)

( * ) Notice: Subject to any disclaimer, the term of this patent is extended or adjusted under 35 U.S.C. 154(b) by 87 days.

(21) Appl. No.: 12/834,471

(22) Filed: Jul. 12, 2010

(65) Prior Publication Data

US 2010/0308052 A1 Dec. 9, 2010

Related U.S. Application Data

(63) Continuation-in-part of application No. 11/833,752, filed on Aug. 3, 2007, now Pat. No. 7,775,395.

(51) Int. Cl.
*B65D 51/04* (2006.01)
*B65D 43/14* (2006.01)

(52) U.S. Cl. ..... 220/836; 220/833

(58) Field of Classification Search ..... 220/254.1, 220/254.4, 268, 833, 836
See application file for complete search history.

(56) References Cited

U.S. PATENT DOCUMENTS

| | | | | |
|---|---|---|---|---|
| 2,541,604 | A | 2/1951 | Normandin | |
| 3,417,897 | A | 12/1968 | Johnson | |
| 4,293,079 | A * | 10/1981 | Lytle | 220/833 |
| 4,375,711 | A | 3/1983 | Franzen et al. | |
| 4,634,019 | A * | 1/1987 | Pherigo | 220/810 |
| 6,003,203 | A | 12/1999 | Fowlston | |
| 6,523,713 | B1 | 2/2003 | Helms | |
| 6,772,904 | B1 | 8/2004 | Gilliam et al. | |
| 7,097,446 | B2 | 8/2006 | Crider | |
| 7,165,695 | B2 * | 1/2007 | Choi | 220/258.2 |
| 2007/0062949 | A1 | 3/2007 | Bordner | |

FOREIGN PATENT DOCUMENTS

| | | |
|---|---|---|
| CH | 471007 | 4/1969 |
| GB | 2382569 A | 6/2003 |
| WO | 0144058 A2 | 6/2001 |

* cited by examiner

*Primary Examiner* — Harry Grosso
(74) *Attorney, Agent, or Firm* — Husch Blackwell LLP

(57) ABSTRACT

A hinged lid for a container receptacle is provided. The lid structure includes a top attached to a mount structure by a "living" hinge. The mount structure is designed for mounting the lid to an open free end of the receptacle. The lid is provided with a retaining mechanism adapted for maintaining the mount structure in a folded position with respect to the top of the lid thereby enabling the lid to be placed on a receptacle using an automatic lidding machine. The retaining feature includes a projection and a recess, wherein the projection is adapted for begin received within the recess. In one embodiment, the projection extends from the mount structure and is adapted to be received within a recess defined in the lid's top. In another embodiment, the projection extends from the lid's top and is adapted to be received within a recess defined in the mount structure.

18 Claims, 4 Drawing Sheets

HINGED LID WITH RETAINING FEATURE

CROSS-REFERENCE TO RELATED APPLICATIONS

This application is a continuation-in-part of and claims priority to U.S. application Ser. No. 11/833,752 filed Aug. 3, 2007 to George Zeiler, et al. entitled Hinged Lid for a Food Container, which issued as U.S. Pat. No. 7,775,395, the entire disclosure, including the specification and drawings, of which is incorporated herein by reference.

BACKGROUND OF INVENTION

Containers for food products are well known in the art. Such containers often include a receptacle and a lid. In the manufacture of many food containers, the receptacle is made from paper stock having a seamed sidewall with an upper rolled lip and a bottom wall connected to the sidewall. The lid, which may be hingedly attached to the receptacle, can be mounted to the receptacle in a variety of manners including via a friction fit, screw connection, an adhesive connection and the like.

It is common practice in the packaging industry to fill the receptacle with a product and thereafter secure the lid to the open end of the receptacle. A variety of lidding machines have been devised for this purpose, including high-speed automated lidding machines. Typical lidding machines include a queue or conveyer containing filled receptacles and a magazine containing lids suitable for attachment to the receptacles. The lidding machine selects a lid from the magazine and places it on a filled receptacle. However, lidding machines are generally not adapted for applying lids having "living" hinges onto receptacles.

Accordingly, a need exists for a lid having a "living" hinge that can be placed on a receptacle by an automatic lidding machine. A further need exist for a lid having a "living" hinge wherein the lid's mount structure can be releasably positioned so as to not interfere when the lid is placed onto the receptacle.

SUMMARY OF INVENTION

The present invention is directed to a hinged lid structure that is configured to be attached to a receptacle. The lid includes a top portion and mount structure connected together by a hinge. The top portion may contain an upper wall with a skirt depending therefrom. The upper wall is designed to overlie at least a portion of the receptacle's free end and the skirt is configured to be positioned outside of and circumscribe at least a portion of the receptacle's free end. The mount structure includes two generally parallel walls forming a channel therebetween configured for receiving a portion of a periphery of the container's sidewall.

The hinge connecting the top to the mount structure may be a "living" hinge constructed of thin flexible material and may be formed integral with the top and mount structure. In order to manufacture the lid as a single integral unit and in a single mold, the lid is typically formed with the mount structure in an open position. Due to the elasticity and resiliency of the "living" hinge, the mount structure is predisposed to stay in an open position and will spring back to an open or partially open position once it is released from its folded position. This prohibits the lid from being applied to the receptacle using a typical automatic lidding machine because the mount structure's channel is not aligned align with the receptacle's sidewall.

The lid is provided with a retaining feature for maintaining the mount structure in a folded relationship with respect to the top. When the mount structure is in a fully folded position, the lid may be placed onto the receptacle in a manner in which the mount structure's channel receives a portion of a periphery of the container's sidewall therein. The retaining feature includes a corresponding projection and recess configured for releasable snapping engagement. In one embodiment, the projection extends from the mount structure and is adapted to be received within a recess defined in either the top's upper wall or skirt. In another embodiment, the projection extends from either the top's upper wall or skirt and is adapted to be received within a recess defined in the mount structure. The lid's retaining features is designed such that the projection may be releasably snapped into the recess to maintain the mount structure in a folded position so that the lid can be attached to the receptacle by an automatic lidding machine.

Certain embodiments of the invention are outlined above in order that the detailed description thereof may be better understood, and in order that the present contributions to the art may be better appreciated. In this respect, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Though some features of the invention may be claimed in dependency, each feature has merit when used independently.

DESCRIPTION OF THE SEVERAL VIEWS OF THE DRAWINGS

Further features of the present invention will become apparent to those skilled in the art to which the present invention relates from reading the following description with reference to the accompanying drawings, in which.

DETAILED DESCRIPTION

Figure 1:
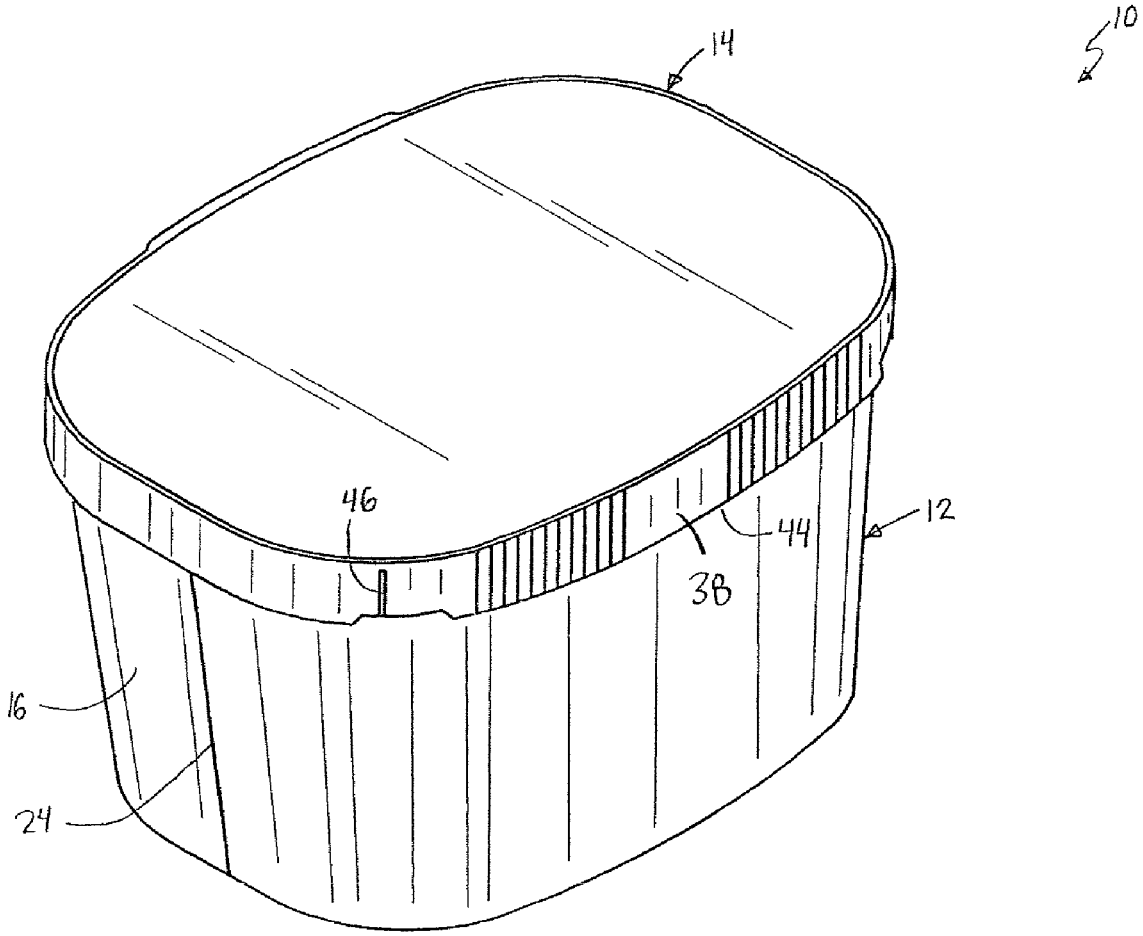
FIG. 1 is a perspective view of a food container showing the lid structure in a closed configuration in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

Figure 2:
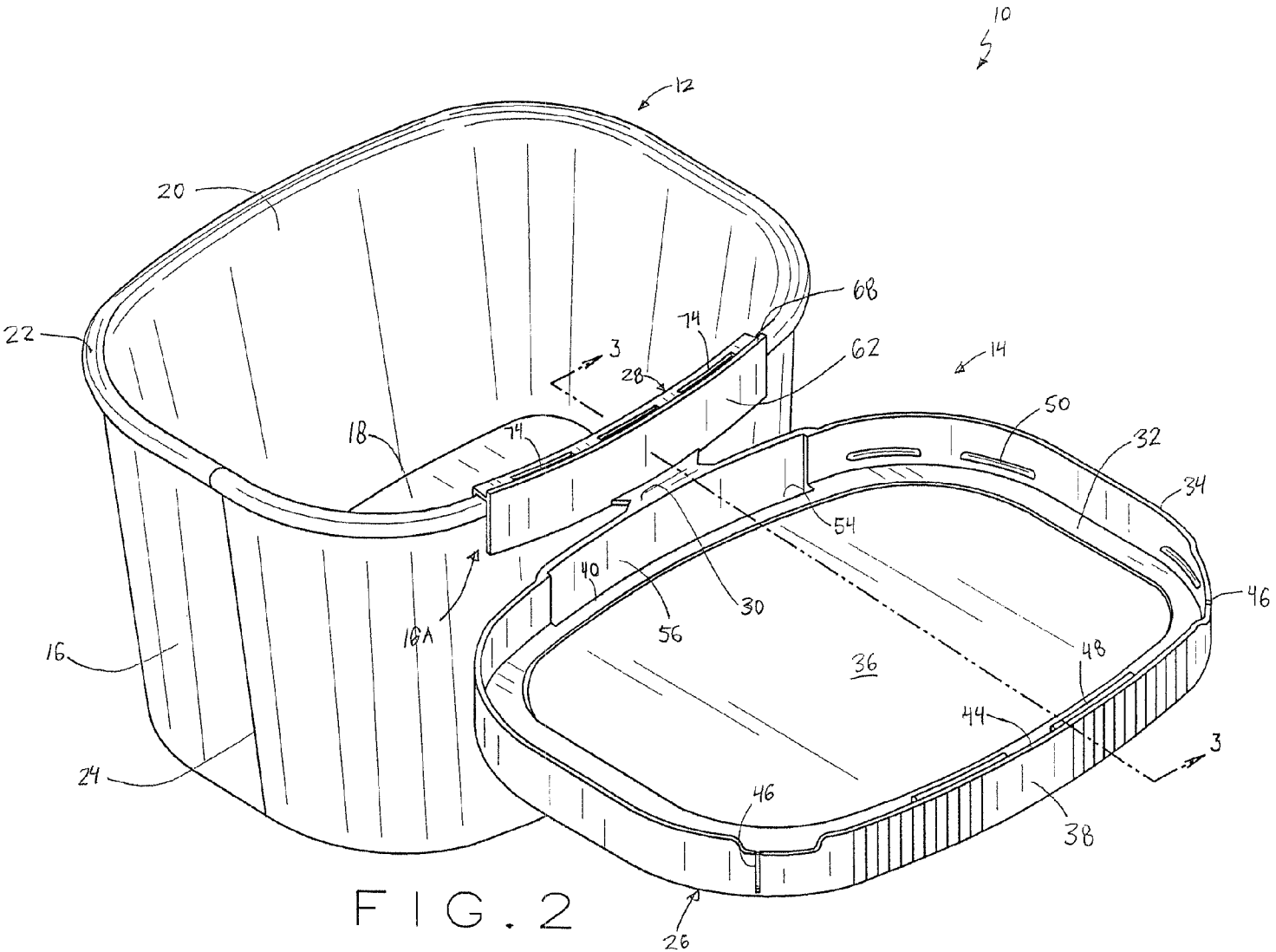
FIG. 2 is a perspective view of the container of FIG. 1 showing the lid structure in an open configuration in accordance with one embodiment of the present invention.

The reference 10 designates generally a container comprising a receptacle 12 and a lid structure 14. In the illustrated structure, the receptacle 12 includes a sidewall 16 and a bottom wall 18. Receptacle 12 has an upper open end 20 that provides an access opening thereto. The upper portion of the receptacle 12 has an outwardly rolled upper lip 22 as best seen in FIG. 2.

In one embodiment, the receptacle 12 is constructed from a paperboard blank and is formed by wrapping the paperboard blank about a mandrel and joining the marginal edge portions of the blank to form a sidewall seam 24. The receptacle 12 includes the bottom wall 18 which may be secured to the sidewall 16 by heat bonding or via the use of adhesives. Such receptacles are well known in the industry. The paperboard can be coated to prevent the migration of components of food, for example, water and/or fat into the paper. The coating can be polyethylene or the like. The receptacle 12 in each of the forms of the invention described herein, can be substantially the same and for convenience are shown as being of the same construction and components. While the cross-sectional shape of the receptacle 12 can be of any suitable shape, the illustrated receptacle 12 has a somewhat rectangular shape with rounded corners. The sidewall 16 is tapered to permit nesting of receptacles 12 for shipping and storage.

Figure 3:
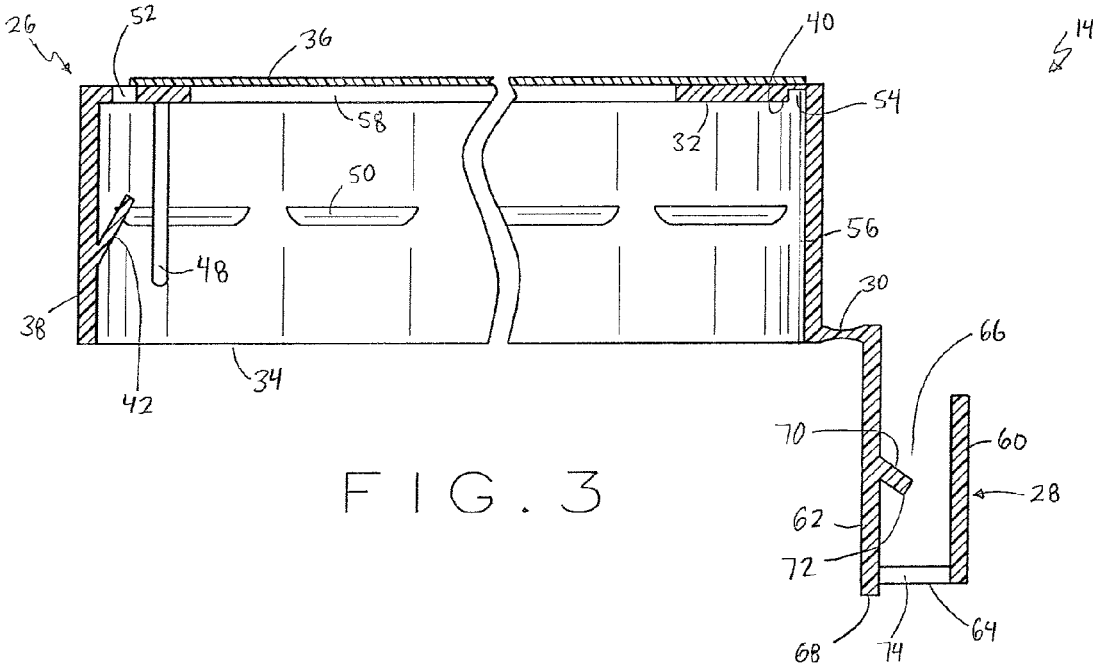
FIG. 3 is an enlarged partial fragmentary view taken along the line 3-3 of FIG. 2 in accordance with one embodiment of the present invention.

The lid structure 14 includes a top portion 26, a mount structure 28 and a hinge 30. As illustrated in FIG. 3, top portion 26 and mount structure 28 are formed as a single integral unit and joined together by the hinge member 30. The lid structure 14 may be injection molded from a durable polymeric material such as low density polyethylene, polypropylene or any other plastic material suitable for forming a "living" hinge.

The top portion 26 is configured to overlie the upper open end 20 of the receptacle 12 when the lid structure 14 is in a closed position. As seen, the top portion 26 is constructed as having a flange 32 for extending around at least a portion of perimeter of the receptacle's upper open end 20 and a skirt 34 depending from the flange 32. The skirt 34 is configured to be positioned outside of and circumscribe at least a portion of the receptacle upper open end 20. The skirt 34 may include a recessed region 56 for accommodating a portion of the mount structure 28 when the lid 14 is in a closed position. The flange 32 defines an opening 58. A paperboard cover 36 may be suitably secured to the flange 32 as, for example, by adhesion or heat sealing and encloses opening 58. The use of a paperboard for cover 36 permits the printing of indicia and information thereon such as a brand name, product type, net weight, nutritional data and the like. However, it should be understood that while the figures show the top portion 26 having a flange 32 defining an opening 58 covered with a paperboard sheet 36, the upper wall of the top portion 26 in other embodiments may be constructed of a continuously planar wall formed of the same polymeric material as the remainder of the lid structure 14.

The top portion 26 of the lid structure 14 may further include a lock protrusion 42 which is in the form of an undercut extending from the skirt 34 or a tamper evident tab 38. The flange 32 is provided with an opening 52 to facilitate molding of the lock protrusion 42 as an integral assembly. When the lid structure 14 is in a closed position, the lock protrusion 42 engages the underside of the receptacle's rolled upper lip 22. As depicted in FIGS. 1 and 2, the tamper evident tab 38 can initially be adjoined to the skirt 34 by fracture zones 46 which consist of thin areas of material operable for being ruptured when the tamper evident tab 38 is partially separated from the skirt 34. When the fracture zones 46 are ruptured, the free edge 44 of the tamper evident tab 38 can be moved away from the skirt 34 to release the lock protrusion 42 from engagement with undersurface of lip 22 to permit the top portion 26 to move to an open position as seen in FIG. 2.

The top portion 26 may also be provided with one or more elongated ribs or bars 48 projecting from the flange 32 opposite the mount structure 28 to help retain the shape of the upper end of the sidewall 16 and prevent tampering when the lid structure 14 is in a closed configuration. The ribs 48 engage an interior surface of the sidewall adjacent 16. Further, the skirt 34 may be provided with one or more ribs 50 extending inwardly therefrom for engaging an undersurface of lip 22 to assist in holding the lid structure 14 in a closed position.

Figure 4:
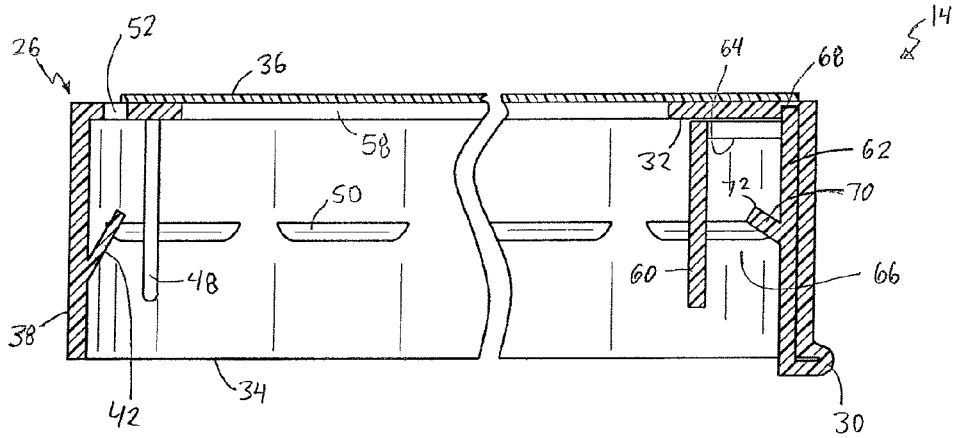
FIG. 4 is an enlarged partial fragmentary view illustrating the lid structure of FIG. 3 with the mount structure retained in a folded position in accordance with one embodiment of the present invention.

The lid's mount structure 28 is best seen in FIGS. 2-5. The mount structure 28 includes a pair of spaced apart wall members 60, 62 forming a channel 66 therebetween configured for receiving at least a portion of the periphery of the sidewall free end therein. As seen in FIG. 4, the mount structure 28 includes a plurality of upwardly angled undercut protrusions 70 projecting into the channel 66. The undercut protrusions 70 are positioned such that their upper ends 72 are located for engagement with the underside of the receptacle's rolled upper lip 22 when the mount structure 28 is attached to the receptacle 12. The mount structure 28 also includes a bight wall 64 extending between walls 60 and 62 providing the mount structure 28 with a generally U-shaped profile as depicted in FIG. 4. As shown, the bight wall 64 has openings 74 above each undercut protrusions 70 so that the undercut protrusions 70 may be formed as an integral part of wall 62.

As best illustrated in FIGS. 2 and 3, the hinge 30 extends between and connects the top portion 26 and mount structure 28 for permitting hinged movement between the two. The hinge 30 may be a "living" hinge constructed of thin flexible material formed integral with the top portion 26 and mount structure 28.

In order to manufacture the lid structure 14 as a single integral unit and in a single mold, the lid structure 14 is typically formed in an open position, similar to that shown in FIG. 3. Due to the elasticity and resiliency of the "living" hinge 30, the lid structure 14 is predisposed to stay in a fully open or partially open position. Even after the mount structure 28 has been moved to a closed or folded position, it will tend to continually spring back to a fully or partially open position once released from the folded position. This prohibits the lid 14 from being placed on the receptacle 12 using a typical automatic lidding machine because the channel 66 of the mount structure 28 is not aligned align with the portion of the sidewall 16A where the mount structure 28 will be secured. To allow the lid 14 to be placed on the receptacle 12 with a lidding machine, the mount structure 28 must be in a closed or folded position with respect to the top 26 as depicted in FIG. 4. This ensures that the channel 66 will be in alignment with the sidewall 16A when the lid 14 is placed down onto the receptacle 12.

In order to retain the mount structure 28 in a folded position so that the lid 14 can be applied to the receptacle 12 using a lidding machine or operation, the lid 14 comprises a retaining feature. The retaining feature includes a corresponding projection and recess configured for releasable snapping engagement. In the embodiment illustrated in FIGS. 2-4, a projection 68 extends from the mount structure's bight wall 64 in a direction generally parallel to wall 62 and is adapted for engaging a recess 54 defined in the upper wall 32 of the top 26. The projection 68 is shown as an elongated ridge extending along the same general plane as wall 62 and the recess 54 is shown as an elongated slot dimensioned for receiving the projection 68 therein.

Figure 5:
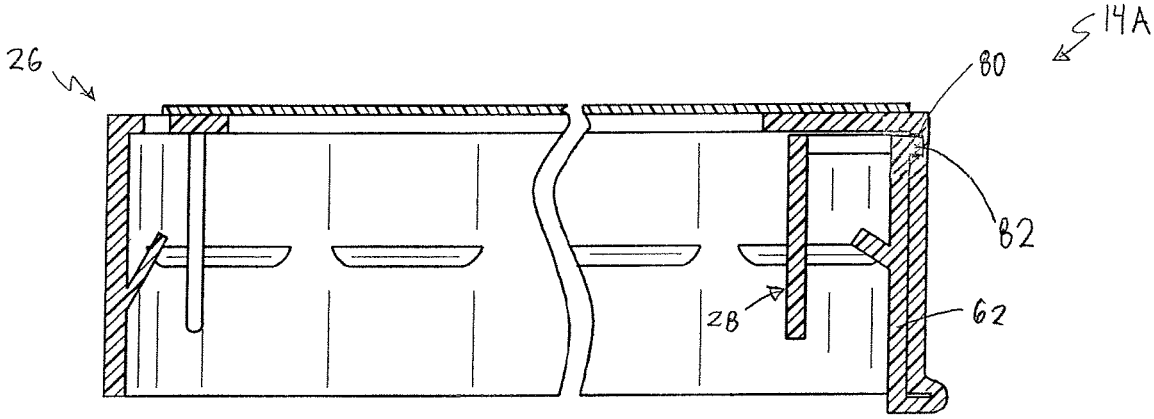
FIG. 5 is an enlarged partial fragmentary view illustrating a lid structure with the mount structure retained in a folded position in accordance with another embodiment of the present invention.

In the embodiment shown in FIG. 5, a projection 82 extends from wall 62 in a direction generally parallel to bight wall 34 and is adapted for engaging a recess 80 defined in the skirt 34 of the top 26. In other embodiments, the projection extends from the top 26 and engages a recess defined in the mount structure 28. For example, the projection may extend downwardly from the top portion's upper wall 32 and be adapted for engaging a recess defined in the mount structure's bight wall 64 or may extend inwardly from the top portion's skirt 34 and be adapted for engaging a recess defined in the mount structure's wall 62. Furthermore, it should be understood that the retaining feature's projection and recess may be formed in any location and orientation and may be of any size, shape or form suitable for maintaining the mount structure 28 in a closed or folded position with respect to the top 26.

The lid 14 is designed so that the projection 68 may be releasably snapped into the recess 54 to hold the mount structure 28 in a folded position. As the mount structure 28 is rotated about hinge 30 toward its fully folded position, the projection 68 contacts and slightly interferes with a portion 40 of the top wall 32 just before the mount structure 28 reaches its fully folded position. The hinge 30 and skirt 34 temporarily deform in order to allow the projection 68 to pass by the area 40 and be snappingly received within recess 54. The hinge 30 and skirt 34 also temporarily deform in order to allow the projection 68 to become snappingly disengaged from recess 54 when mount structure 28 is rotated away from its fully folded position. Once the lid 14 is applied to a receptacle 12, the retaining feature, along with the lock protrusion 42 and ribs 50, aid in maintaining the lid 14 in a closed position covering the receptacle's open end 20.

From the foregoing, it may be seen that the hinged lid of the present invention is particularly well suited for the proposed usages thereof. Furthermore, since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

We claim:

1. A hinged lid structure configured to be attached to a container receptacle having a free end, a sidewall depending therefrom, and a bottom, said lid structure comprising:

a top including an upper wall and a skirt depending therefrom, said upper wall configured to overlie said receptacle free end and said skirt configured to be positioned outside of and circumscribe at least a portion of said receptacle free end;

a mount structure configured for receiving at least a portion of a periphery of the free end of said receptacle sidewall;

a hinge connecting said skirt to said mount structure; and a retaining mechanism including a projection extending from one of said top and mount structure and a recess defined in the other of said top and mount structure, said projection adapted for being received by said recess for retaining said mount structure in a closed position with respect to said top.

2. The hinged lid structure of claim 1 wherein said projection extends from said mount structure and said recess is defined in said top.

3. The hinged lid structure of claim 1 wherein said projection extends from said top and said recess is defined in said mount structure.

4. The hinged lid structure of claim 1 wherein said projection is configured for releasable snapping engagement with said recess to retain said mount structure in said closed position.

5. The hinged lid structure of claim 1 wherein said hinge is a living hinge.

6. The hinged lid structure of claim 1 wherein said top, mount structure, retaining mechanism and hinge are molded as a single integral unit.

7. The hinged lid structure of claim 1 wherein said mount structure includes a pair of spaced apart wall members forming a channel therebetween configured to receive less than the entire periphery of the free end of said receptacle sidewall.

8. The hinged lid structure of claim 7 wherein said mount structure further includes a bight wall extending between said wall members, said mount structure being generally U-shaped.

9. The hinged lid structure of claim 7 wherein said projection is an elongated ridge extending from said bight wall and said recess is an elongated slot defined in said top.

10. The hinged lid structure of claim 1 further comprising a rib protruding from said upper wall for engaging an interior surface of said receptacle sidewall when said lid is in a closed position.

11. The hinged lid structure of claim 10 wherein said rib is generally parallel with said skirt and provides said receptacle free end with structural support when said lid is in a closed position.

12. A hinged lid structure configured to be attached to a container having a free end, a sidewall depending therefrom, and a bottom, said lid structure comprising:

a top including an upper wall and a skirt depending therefrom, said upper wall configured to overlie said container free end and said skirt configured to be positioned outside of and circumscribe at least a portion of said container free end, wherein an inner surface of said upper wall includes a recess defined therein;

a mount structure including a pair of spaced apart wall members forming a channel therebetween configured for receiving at least a portion of a periphery of the free end of said container sidewall, said mount structure including a projection extending in a direction generally parallel to at least one of said wall members, said projection being adapted for releasable snapping engagement with said recess for retaining said mount structure in a closed position with respect to said top; and a living hinge connecting said skirt to said mount structure permitting hinged movement of said top relative to said mount structure;

wherein said top, mount structure and hinge are molded as a single integral unit.

13. The hinged lid structure of claim 12 wherein said mount structure further includes a bight wall extending between said wall members, said mount structure being generally U-shaped.

14. The hinged lid structure of claim 12 wherein said projection is an elongated ridge extending from said mount structure and said recess is an elongated slot defined in said top.

15. The hinged lid structure of claim 1 wherein said mount structure comprises an inner wall member and an outer wall member spaced apart from one another to form a channel and wherein said projection extends from said mount structure in a direction generally parallel to said outer wall member.

16. The hinged lid structure of claim 15 wherein said recess is defined in an inner surface of said upper wall of said top.

17. The hinged lid structure of claim 15 wherein said hinge connects said skirt to said outer wall member of said mount structure such that substantially the entire container free end is uncovered when said top is in an open position with respect to said mount structure.

18. The hinged lid structure of claim 1 wherein said retaining mechanism is concealed by said upper wall and skirt when said mount structure is in a closed position with respect to said top.

* * * * *